United States Patent [19]

Schapira et al.

[11] Patent Number: 4,668,307

[45] Date of Patent: May 26, 1987

[54] BATH AND PROCESS FOR THE CHEMICAL CONVERSION OF METAL SUBSTRATES WITH ZINC

[75] Inventors: Joseph Schapira, Paris; Victor Ken, Colombes; Christian Hoessler, Enghien Les Bains; Louis Cot, Clapiers; Jean-Henri Durand, Montpellier; Patrice Pelletier, Lambesc, all of France

[73] Assignee: Compagnie Francaise de Produits, Gennevilliers, France

[21] Appl. No.: 811,841

[22] Filed: Dec. 20, 1985

[30] Foreign Application Priority Data

Dec. 21, 1984 [FR] France ..... 84 19709

[51] Int. Cl.[4] ..... C23C 22/12

[52] U.S. Cl. ..... 148/6.15 Z

[58] Field of Search ..... 148/6.15 Z

[56] References Cited

U.S. PATENT DOCUMENTS 4,153,478 5/1979 Parant ..... 148/6.15 Z
4,391,652 7/1983 Das et al. .

FOREIGN PATENT DOCUMENTS 1177292 6/1957 France .
1477179 4/1966 France .
1538275 10/1967 France .

*Primary Examiner*—Sam Silverberg
*Attorney, Agent, or Firm*—Fleit, Jacobson, Cohn & Price

[57] ABSTRACT

Chemical conversion bath with zinc characterized by the fact that it comprises, besides the conventional constituents, an effective amount of fluorophosphate ion of the formula:

$$F—PO_3^{2-}$$

which can be introduced in the form of the corresponding acid, one of its alkali, alkaline-earth or ammonium salts or its zinc salt.

10 Claims, No Drawings

BATH AND PROCESS FOR THE CHEMICAL CONVERSION OF METAL SUBSTRATES WITH ZINC

The invention relates to a bath and a process for the chemical conversion of metal substrates with zinc, particularly those based on iron, zinc, aluminum and alloys of these metals.

It is also aimed at a concentrate adapted to permit the preparation of the above-said baths.

It is recalled that, by the expression "chemical conversion" is meant surface transformations of metals, particularly in an acid medium, enabling their intrinsic properties to be modified and novel physical or physicochemical characteristics to be conferred on them, particularly to increase their corrosion resistance and to facilitate the adherence of film-forming coatings applied subsequently.

Traditionally, this chemical conversion of metal substrates is carried out by conventional treatments of phosphatization with zinc and results in the deposition at the surface of the metal of a fine layer of insoluble phosphate.

Generally, conventional treatments of phosphatization employ acid solutions which, before use, contain the following constituents:

phosphoric acid $H_3PO_4$, a primary metal phosphate $(H_2PO_4)_2Me$, Me representing often zinc and/or iron, but can also represents manganese, nickel, copper, calcium, magnesium or their mixtures, an accelerator constituted by elements such as chlorates, nitrites and/or nitrates, sodium metanitrobenzenesulfonate, peroxides.

These treatments may be carried out by spraying the above-said solutions onto the articles to be treated or by immersion of the latter in baths constituted by these solutions, generally at temperatures above 30° C.

The spraying or dipping treatment is inserted as follows in a sequence of operational steps which can include:

one or several degreasing steps, one or several rinsing steps, preferably, a step of conditioning the surface of the substrate to be treated, the step itself of chemical conversion with zinc, a rinsing step, preferably, a step of passivation in a chromic medium, a rinsing step, a drying or stoving step.

There already exist numerous chemical conversion baths certain of which contain free or complexes fluorides in the form particularly of hydrofluoric (HF), fluorosilicic ($H_2SiF_6$) or fluoboric ($HBF_4$) acids.

In face of the constantly increasing demands of users in the matter of resistance to corrosion of articles based on iron, zinc, aluminum and their alloys, Applicants sought to improve existing chemical conversion baths and have had the merit of discovering, following lengthy research, that the employment in a bath for phosphatizing with zinc of an effective amount of at least one compound including at least one fluorine atom chemically linked to a phosphorus atom, preferably an effective amount of fluorophosphate ion, enabled the desired object to be achieved.

It follows that the chemical conversion bath with zinc according to the invention includes, besides the conventional constituents, an effective amount of at least one compound including at least one fluorine atom linked chemically to a phosphorus atom, preferably an effective amount of a fluorophosphate ion of the formula:

$$F—PO_3^{2-}$$

which can be introduced in the form of the corresponding acid, one of its alkali, alkaline-earth or ammonium salts or its zinc salt.

According to an advantageous embodiment, the above-said bath comprises from 1 to 10 g/l, preferably from 2 to 7 g/l, of zinc ion and from 1 to 10 g/l, preferably from 2 to 7 g/l, of fluorophosphate ion.

The chemical conversion process according to the invention consists of employing on the substrates to be treated, the above-said bath by spraying or by dipping of the substrates, the temperature of the bath being from 30° to 70° C., preferably from 50° to 55° C., contact between bath and substrate being maintained for 5 to 200 seconds.

The concentrate according to the invention comprised the fluorophosphate ion, the zinc ion and the conventional constituents of the chemical conversion bath according to the invention in proportions such that this bath may be obtained by dilution with the appropriate amount of water.

According to an advantageous embodiment, said concentrate has the following percentage composition:

zinc ion comprised between 2 and 20 g, preferably between 2 and 14 g per 100 g of concentrate, monofluorophosphate ion comprised between 2 and 20 g, preferably between 2 and 14 per 100 g of concentrate, phosphate ion comprised between 6 and 40 g, preferably between 6 and 30 g per 100 g of concentrate, nickel ion comprised between 1 and 4 g, preferably between 1 and 2 g per 100 g of concentrate.

The invention is directed also at a certain number of other features which will be considered below and, in particular, the application of the fluorophosphate ion in chemical conversion baths.

It will, in any case, be well understood by means of the additional description which follows and of the examples, said additional description and said examples relating to advantageous embodiments.

Proposing, consequently, to constitute the chemical conversion bath according to the invention, a conventional chemical conversion bath with zinc is made to include an amount of 1 to 10 g/l, preferably from 2 to 7 g/l, of zinc ion and from 1 to 10 g/l, preferably from 2 to 7 g/l of fluorophosphate ion.

The above-said bath is acid, preferably from pH 2.6 to 3.3, and comprises besides the zinc ion and the fluorophosphate ion, orthophosphoric acid $H_3PO_4$, nickel ion, as the case may require, the conventional ions used in chemical conversion baths, namely Ca, Fe, Mn and the like, an accelerator selected from the group comprising nitrites and/or nitrates, chlorates and the like.

The fluorophosphate anion may be introduced in the form of alkali or ammonium monofluorophosphate, particularly potassium $K_2PO_3F$, zinc monofluorophosphate $ZnPO_3F$ and the like, or their mixtures.

Zinc ion may be introduced in any suitable manner and particularly in the form of its salts such as the nitrate or the phosphate or its oxide.

The nickel ion may be introduced in any suitable manner and particularly in the form of its salts such as the carbonate or the nitrate.

The best results are obtained when the zinc is introduced in a form combined with the monofluorophosphate anion.

The phosphate ion is present in an amount comprised between 3 and 20 g/l, preferably between 3 and 15 g/l, and the nickel ion in an amount comprised between 0.5 and 2 g/l, preferably 0.5 to 1 g/l.

The accelerator may be present in an amount comprised between 40 and 150 mg/l.

The conventional ions such as Fe, Ca, Mn may be present in an amount comprised between 0 and 5 g/l.

Particular compositions of a chemical conversion bath according to the invention are given in the examples.

An advantageous composition of a concentrate is the following:

| | |
|---|---|
| industrial water | 32.9 |
| $ZnPO_3F$ | 8.0 |
| ZnO | 6.8 |
| $H_3PO_4$ 75% | 24.8 |
| $HNO_3$ 58% | 22.5 |
| $Ni(NO_3)_2 6H_2O$ | 5.0. |

To adjust as necessary, the content of $K_2PO_3F$ there may be provided a solution of this product comprising 3.8 g of $K_2PO_3F$ in 96.2 g of industrial water.

It is also possible to provide for marketing the concentrate in the form of a "kit" with two containers containing respectively the concentrate and the aqueous $K_2PO_3F$ solution.

To prepare the bath according to the invention from such a concentrate, the latter is diluted with about 95% of industrial water.

The employment of the bath according to the invention within the scope of the process according to the invention results in conversion layers having a remarkable resistance to corrosion, distinctly higher than that shown by the layers obtained according to conventional phosphatization processes.

In the examples which follow, the advantageous results obtained by means of compounds in which a fluorine atom is linked chemically to a phosphorus atom, with respect to the results obtained with conventional baths, of which certain are based on compounds including a free or complexed fluorine atom, are demonstrated. To illustrate the resistance to corrosion of the conversion layer in the building of which the compounds used according to the invention and particularly the monofluorophosphate ion participate favourably, metal substrates treated in the baths according to the invention were subjected to accelerated corrosion tests like that called "salt spray" according to standard NF X 41-002.

The substrates used were metal specimens of approximately equal dimensions, in the neighbourhood of 10×10 cm, constituted by cold rolled steel sheets,
galvanized metal sheets,
electrozinced sheets.

These specimens were treated either in a chemical conversion bath by the dipping conventionally used in the industry, or in various baths according to the invention.

Prior to this chemical conversion treatment, the specimens were also subjected to the same range of pretreatment recommended by Applicant Company, namely:

(1) alkaline degreasing by dipping (in two stages) using a degreasing bath constituted by an inorganic base based on soda and by a wetting base based on non-ionic surface active agents, marketed by Applicants in the form of two products respectively of the trademark "RIDOLINE 1550 CF/2" and "RIDOSOL 550 CF", the two stages being characterized for the first:

by a concentration of 1.8% by volume of RIDOLINE 1550 CF/2+10%, with respect to the charge, of RIDOSOL 550 CF,
by a temperature of 65° C.,
by a duration of 4 minutes, for the second:

by a concentration of 0.3% by volume of RIDOLINE 1550 CF/2,
by a temperature of 60° C.,
by a duration of 2 minutes, (2) cold water rinsing by dipping for 2 minutes in industrial water, (3) surface conditioning by dipping in demineralized water by means of a refining agent based on titanium phosphate, marketed by Applicants under the trademark "FIXODINE 5", concentration being 2 g/l and the duration 2 minutes.

The specimens were dipped for 150 seconds in one of the above-said chemical conversions baths.

Finally, they were subjected to a rinsing step,
a passivation step in a chromic medium,
a rinsing step,
a drying or stoving step.

EXAMPLE 1

This was a comparative example employing a conventional bath, denoted below by Bath A and whose composition was as follows:

| | |
|---|---|
| $PO_4^{3-}$ | 15 g/l |
| $Zn^{++}$ | 0.8 g/l |
| $ClO_3^-$ | 0.6 g/l |
| $Ni^{++}$ | 0.65 g/l |
| $NO_3^-$ | 7.5 g/l |
| $NO_2^-$ | 40 mg/l. |

Ten samples of each of the specimen types identified above were treated in Bath A for 150 seconds, then rinsed and finally stoved at 110° C. for 10 minutes.

To evaluate their resistance to corrosion, the various specimens so treated were exposed to the attack of a salt mist, obtained by means of a salt mist test apparatus. The conditions of these tests were as follows:

temperature existing in the enclosure: 35° C.±1
5% solution of NaCl, the pH equal to 7, used to form the salt mist,
humidity of the air filling the enclosure: 85–90% (relative humidity) and pressure within the enclosure: 1 bar.

The effectiveness of the conversion treatment was evaluated visually and the results, that is to say the progress of the oxidation expressed in % for a given duration of exposure, are shown in Table 1.

EXAMPLE 2

This was an example employing a bath according to the invention, named below Bath B and whose composition was as follows:

| | |
|---|---|
| $Zn^{++}$ | 4.88 g/l |
| $PO_3F^{2-}$ | 5.0 g/l |
| $PO_4^{3-}$ | 7.3 g/l |
| $Ni^{++}$ | 0.5 g/l |
| $NO_3^-$ | 6.6 g/l |
| $K^+$ | 1.79 g/l |
| $NO_2^-$ | 40 mg/l. |

In the same way as in the preceding example, ten samples of each of the types of specimens were dipped for 150 seconds in Bath B, then rinsed and then stoved at 110° C. for 10 minutes and finally exposed to the salt mist under the conditions described in example 1.

The effectiveness of the conversion treatment was evaluated visually and the results, that is to say the progress of the oxidation expressed in % for a given duration of exposure, are shown in Table 1.

EXAMPLE 3

This is a comparative example employing a conventional bath in which has been incorporated an equivalent amount to that of the preceding example of the fluoride ion, in free form, particularly in the form of HF, called Bath C and whose composition was as follows:

| | |
|---|---|
| $PO_4^{3-}$ | 15 g/l |
| $Zn^{++}$ | 1.4 g/l |
| $F^-$ | 1.0 g/l |
| $ClO_3^-$ | 0.6 g/l |
| $NO_3^-$ | 7.5 g/l |
| $NO_2^-$ | 40 mg/l. |

In the same way as in the preceding example, ten samples of each of the types of specimens were dipped for 150 seconds in Bath C, then rinsed and then stoved at 110° C. for 10 minutes and finally exposed to the salt mist under the conditions explained in example 1.

The effectiveness of the conversion treatment was evaluated visually and the results, that is to say the progress of the oxidation expressed in % for a given duration of exposure, are shown in Table 1.

EXAMPLE 4

This was an example employing a bath according to the invention, called below Bath D and whose composition was as follows:

| | |
|---|---|
| $Zn^{++}$ | 2 g/l |
| $PO_3F^{2-}$ | 3.0 g/l |
| $PO_4^{3-}$ | 10 g/l |
| $Ni^{++}$ | 0.5 g/l |
| $NO_3^-$ | 6.6 g/l |
| $NO_2^-$ | 40 mg/l. |

In the same way as in the preceding example, ten samples of each of the types of specimens were dipped for 150 seconds in Bath D, then rinsed and then stoved at 110° C. for 10 minutes and finally exposed to the salt mist under the conditions described in example 1.

The effectiveness of the conversion treatment was evaluated visually and the results, that is to say the progress of the oxidation expressed in % for a given duration of exposure, are shown in Table 1.

EXAMPLE 5

This was an example employing a bath according to the invention, called below Bath E and whose composition was as follows:

| | |
|---|---|
| $Zn^{++}$ | 7.0 g/l |
| $PO_3F^{2-}$ | 7.0 g/l |
| $PO_4^{3-}$ | 6.0 g/l |
| $Ni^{++}$ | 0.5 g/l |

In the same way as in the preceding example, ten samples of each of the types of specimens were dipped for 150 seconds in Bath E, then rinsed and then stoved at 110° C. for 10 minutes and finally exposed to the salt mist under the conditions described in example 1.

The effectiveness of the conversion treatment was evaluated visually and the results, that is to say the progress of the oxidation expressed in % for a given duration of exposure, are shown in Table 1.

TABLE 1

| Nature of the specimen | Bath A | Bath B | Bath C | Bath D | Bath E |
|---|---|---|---|---|---|
| steel sheets | Total rusting, that is to say 100%, after 6 h exposure | Traces of slight rust that is to say 10% after 30 h exposure | 100% rusting after 6 h exposure | 50% rusting after 30 h exposure | 20% rusting after 30 h exposure |
| galvanized sheets | Appearance of brown rust after about 200 h exposure | Appearance of red rust stains after 400 h exposure | Appearance of numerous stains of red rust after about 200 h exposure | Appearance of numerous stains after about 300 h exposure | Appearance of numerous stains after about 400 h exposure |
| electro-zinced sheets | Total rusting, that is to say 100% after 6 h exposure | Grayish appearance, no alteration of the surface after 30 h exposure; 0% rusting | Total rusting, that is to say 100% of the surface after 8 h exposure | 30% rusting after 30 h exposure | Grayish appearance 10% rusting after 30 h exposure |

As is self-evident and as results besides already from the foregoing, the invention is in no way limited to those of its types of application and embodiments which have been more especially envisaged; it encompasses, on the contrary, all modifications.

We claim:

1. In an acid bath for the chemical conversion with zinc of a metal substrate selected from those consisting of iron, zinc, aluminum and their alloys, said bath comprising orthophosphoric acid and the nickel ion, the improvement according to which the said bath further comprises an effective amount of a fluorophosphate ion represented by the formula:

$$F—PO_3^{2-}$$

the said fluorophosphate ion being introduced in the said bath by way of the corresponding acid, or by way of one of its salts selected from the group consisting of alkali, alkaline-earth, ammonium or zinc salts.

2. Bath according to claim 1, comprising from 1 to 10 g/l of zinc ion and from 1 to 10 g/l of fluorophosphate ion.

3. Bath according to claim 1, comprising from 2 to 7 g/l of zinc ion and from 2 to 7 g/l of fluorophosphate ion.

4. Bath according to claim 1, consisting of $Zn^{++}$ in an amount of 4.88 g/l $PO_3F^{2-}$ in an amount of 5.0 g/l $PO_4^{3-}$ in an amount of 7.3 g/l $Ni^{++}$ in an amount of 0.5 g/l $NO_3^-$ in an amount of 6.6 g/l $K^+$ in an amount of 1.79 g/l $NO_2^-$ in an amount of 40 mg/l.

5. Concentrate consisting of zinc ion, monofluorophosphate ion, phosphate ion and nickel ion and adapted for the preparation of a chemical conversion bath according to claim 1 by dilution with water, the percentage composition of the said concentrate with respect to the said ions being such that the amount:

of zinc ion is comprised between 2 and 20 g per 100 g of concentrate, of monofluorophosphate ion is comprised between 2 and 20 g per 100 g of concentrate, of phosphate ion is comprised between 6 and 40 g per 100 g of concentrate, of nickel ion is comprised between 1 and 4 g per 100 g of concentrate.

6. Concentrate consisting of zinc ion, monofluorophosphate ion, phosphate ion and nickel ion and adapted for the preparation of a chemical conversion bath according to claim 1 by dilution with water, the percentage composition of the said concentrate with respect to the said ions being such that the amount:

of zinc ion is comprised between 2 and 14 g per 100 g of concentrate, of monofluorophosphate ion is comprised between 2 and 14 g per 100 g of concentrate, of phosphate ion is comprised between 6 and 30 g per 100 g of concentrate, of nickel ion is comprised between 1 and 2 g per 100 g of concentrate.

7. In a process for the chemical conversion with zinc of a metal substrate selected from those consisting of iron, zinc, aluminum and their alloys, said process comprising:

at least one degreasing step, at least one rinsing step, the step proper of chemical conversion with zinc, a rinsing step, a drying or stoving step, the improvement according to which the step of chemical conversion with zinc is carried out using a bath according to claim 1, the temperature of the bath being from 30° to 70° C. and the contact between bath and substrate being maintained for 5 to 200 seconds.

8. Process according to claim 7, comprising, between degreasing and the chemical conversion proper, a step of conditioning the surface of the substrate to be treated and, between the chemical conversion proper and the drying, a step of passivation in a chromic medium.

9. Process according to claim 7, wherein the bath used in the chemical conversion step proper has a temperature of 50° to 55° C. and a pH of 2.6 to 3.3.

10. Process for the preparation of an acid bath comprising orthophosphoric acid and the nickel ion for the chemical conversion with zinc of metal substrates selected from those consisting of iron, zinc, aluminum and their alloys, wherein an effective amount of the fluorophosphate ion of the formula $F—PO_3^{2-}$ is introduced in the said bath by way of the corresponding acid, or by way of one of its salts selected from the group consisting of alkali, alkaline-earth, ammonium or zinc salts.

* * * * *